US010923051B2

(12) United States Patent
Li et al.

(10) Patent No.: US 10,923,051 B2
(45) Date of Patent: Feb. 16, 2021

(54) METHOD AND APPARATUS FOR BACKLIGHT BLACK FRAME INSERTION OPTIMIZATION, MEDIUM, AND ELECTRONIC DEVICE

(71) Applicants: Beijing BOE Optoelectronics Technology Co., Ltd., Beijing (CN); BOE TECHNOLOGY GROUP CO., LTD., Beijing (CN)

(72) Inventors: Xi Li, Beijing (CN); Yuanjie Lu, Beijing (CN); Jinghua Miao, Beijing (CN); Bin Zhao, Beijing (CN); Wenyu Li, Beijing (CN); Xuefeng Wang, Beijing (CN); Yukun Sun, Beijing (CN); Jinbao Peng, Beijing (CN); Zhifu Li, Beijing (CN); Qingwen Fan, Beijing (CN); Jianwen Suo, Beijing (CN); Hao Zhang, Beijing (CN); Lili Chen, Beijing (CN); Jiankang Sun, Beijing (CN); Lixin Wang, Beijing (CN); Ziqiang Guo, Beijing (CN)

(73) Assignees: Beijing BOE Optoelectronics Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/553,497

(22) Filed: Aug. 28, 2019

(65) Prior Publication Data

US 2020/0243026 A1 Jul. 30, 2020

(30) Foreign Application Priority Data

Jan. 28, 2019 (CN) ..... 2019 1 0079415

(51) Int. Cl.
*G09G 3/36* (2006.01)

(52) U.S. Cl.
CPC ..... *G09G 3/36* (2013.01); *G09G 2310/0237* (2013.01); *G09G 2320/0257* (2013.01); *G09G 2320/0261* (2013.01)

(58) Field of Classification Search
CPC ..... G09G 3/3406; G09G 3/36; G09G 2310/0237; G09G 2320/0257; G09G 2320/0261; G09G 3/34; G09G 3/3413
See application file for complete search history.

(56) References Cited

U.S. PATENT DOCUMENTS

2005/0243223 A1* 11/2005 Slobodin ..... H04N 9/3114 349/7
2008/0074381 A1* 3/2008 Kumamoto ..... G09G 3/342 345/102

(Continued)

FOREIGN PATENT DOCUMENTS

CN 106981272 7/2017
CN 107688240 2/2018

(Continued)

OTHER PUBLICATIONS

1st Office Action dated Mar. 2, 2020 for Chinese Patent Application No. 201910079415.5.

*Primary Examiner* — Tom V Sheng
(74) *Attorney, Agent, or Firm* — Thomas | Horstemeyer LLP

(57) ABSTRACT

A method for backlight black frame insertion optimization includes: acquiring a current display mode of the wearable smart device; acquiring a current motion state of the wearable smart device; and generating a control signal according to the current display mode and the current motion state to adjust backlight black frame insertion of the wearable smart device.

17 Claims, 8 Drawing Sheets

(56) References Cited

U.S. PATENT DOCUMENTS

| | | | | |
|---|---|---|---|---|
| 2009/0243995 | A1* | 10/2009 | Kimura | G09G 3/3648 345/102 |
| 2010/0171776 | A1* | 7/2010 | Yamagata | G09G 3/3406 345/691 |
| 2014/0273849 | A1* | 9/2014 | Lee | G06F 1/163 455/41.2 |
| 2014/0306873 | A1* | 10/2014 | Yamashita | G09G 3/3426 345/102 |
| 2015/0170581 | A1 | 6/2015 | Zhang | |
| 2017/0123492 | A1* | 5/2017 | Marggraff | H04N 5/247 |
| 2017/0219833 | A1* | 8/2017 | Mayama | G09G 3/20 |
| 2019/0258114 | A1* | 8/2019 | Kwon | G09G 3/34 |

FOREIGN PATENT DOCUMENTS

| | | |
|---|---|---|
| CN | 108735169 | 11/2018 |
| CN | 109166545 | 1/2019 |
| CN | 109271014 | 1/2019 |

* cited by examiner

METHOD AND APPARATUS FOR BACKLIGHT BLACK FRAME INSERTION OPTIMIZATION, MEDIUM, AND ELECTRONIC DEVICE

CROSS REFERENCE

The present application claims priority to Chinese Patent Application No. 201910079415.5 filed Jan. 28, 2019, the entire contents of which are incorporated herein by reference.

TECHNICAL FIELD

The present disclosure relates to the field of electronic data processing technologies and, more particularly, to a method and an apparatus for backlight black frame insertion optimization, a medium, and an electronic device.

BACKGROUND

In liquid crystal display apparatuses, backlight black frame insertion may be performed to solve the problem of afterimage brought about by liquid crystal response time.

SUMMARY

An objective of the present disclosure is to provide a method and an apparatus for backlight black frame insertion optimization, a medium, and an electronic device.

Other features and advantages of the present disclosure will become apparent from the following detailed description, or in part, by practice of the present disclosure.

According to a first aspect of the present disclosure, there is provided a method for backlight black frame insertion optimization, which is applied to a wearable smart device. The method includes: acquiring a current display mode of the wearable smart device; acquiring a current motion state of the wearable smart device; and generating a control signal according to the current display mode and the current motion state to adjust backlight black frame insertion of the wearable smart device.

In an exemplary embodiment of the present disclosure, the wearable smart device includes a sensor, and the acquiring of the current motion state of the wearable smart device includes: acquiring raw data collected by the sensor; processing the raw data to obtain current posture information of the wearable smart device; and determining the current motion state of the wearable smart device according to historical posture information and the current posture information of the wearable smart device. The current motion state includes a continuous motion state and a non-continuous motion state.

In an exemplary embodiment of the present disclosure, the control signal includes a first control signal. Generating a control signal according to the current display mode and the current motion state to adjust backlight black frame insertion of the wearable smart device includes: generating the first control signal to control the wearable smart device to perform backlight black frame insertion in response to the current display mode being a non-two-dimensional display mode and the wearable smart device being in the continuous motion state.

In an exemplary embodiment of the present disclosure, the control signal includes a second control signal. Generating a control signal according to the current display mode and the current motion state to adjust backlight black frame insertion of the wearable smart device includes: generating the second control signal to control the wearable smart device not to perform backlight black frame insertion in response to the current display mode being a two-dimensional display mode or the current display mode being a non-two-dimensional display mode and the wearable smart device being in the non-continuous motion state.

In an exemplary embodiment of the present disclosure, the current posture information is $N^{th}$ posture information, and the historical posture information includes $(N-1)^{th}$ posture information and $(N-2)^{th}$ posture information, N being a positive integer greater than or equal to 3. Determining the current motion state of the wearable smart device according to historical posture information and the current posture information of the wearable smart device includes: obtaining a posture variation degree of the $(N-1)^{th}$ posture and a posture variation degree of the $(N-2)^{th}$ posture according to the $(N-1)^{th}$ posture information and the $(N-2)^{th}$ posture information; obtaining a posture variation degree of the $N^{th}$ posture and the posture variation degree of the $(N-2)^{th}$ posture according to the $N^{th}$ posture information and the $(N-2)^{th}$ posture information in response to the posture variation degree of the $(N-1)^{th}$ posture and the posture variation degree of the $(N-2)^{th}$ posture exceeding a predetermined threshold; and determining the current motion state of the wearable smart device as the continuous motion state in response to the posture variation degree of the $N^{th}$ posture and the posture variation degree of the $(N-2)^{th}$ posture exceeding the predetermined threshold.

In an exemplary embodiment of the present disclosure, determining the current motion state of the wearable smart device according to historical posture information and the current posture information of the wearable smart device further includes: determining the current motion state of the wearable smart device as the non-continuous motion state in response to the posture variation degree of the $(N-1)^{th}$ posture and the posture variation degree of the $(N-2)^{th}$ posture not exceeding the predetermined threshold or the posture variation degree of the $N^{th}$ posture and the posture variation degree of the $(N-2)^{th}$ posture not exceeding the predetermined threshold.

According to a second aspect of the present disclosure, there is provided a method for backlight black frame insertion optimization. The method is applied to a wearable smart device, which includes a processor, a backlight driver chip, and a backlight. The method includes: acquiring, by the processor, a current display mode and a current motion state of the wearable smart device; generating, by the processor, a control signal according to the current display mode and the current motion state; and generating a pulse modulation signal by the backlight driver chip according to the control signal to control on/off of a backlight lamp of the backlight.

In an exemplary embodiment of the present disclosure, the wearable smart device further includes a sensor, and the processor includes a kernel layer, a native layer, and an application layer. The acquiring, by the processor, a current motion state of the wearable smart device includes: transferring raw data of the wearable smart device collected by the sensor to the native layer through the kernel layer; obtaining a quaternion by performing data fusion on the native layer, converting the quaternion into an Euler angle, and sending the Euler angle to the application layer; and obtaining, by the application layer, the current motion state of the wearable smart device according to the Euler angle.

In an exemplary embodiment of the present disclosure, the wearable smart device further includes a backlight controller. Generating, by the processor, a control signal according to the current display mode and the current motion state includes: generating, by the application layer, the control signal according to the current display mode and the current motion state; and sending, by the application layer, the control signal to the backlight controller via the native layer and the kernel layer sequentially.

In an exemplary embodiment of the present disclosure, the control signal includes a second control signal and a first control signal. Generating a pulse modulation signal by the backlight driver chip according to the control signal to control on/off of a backlight lamp of the backlight includes: parsing the control signal and sending the same to the backlight driver chip by the backlight controller; generating, by the backlight driver chip, a pulse modulation signal having a predetermined duty cycle to alternately turn on and off the backlight lamp in response to the control signal being the first control signal; and generating a DC signal by the backlight driver chip to continuously turn on the backlight lamp in response to the control signal being the second control signal.

In an exemplary embodiment of the present disclosure, the wearable smart device is a virtual reality device.

According to a third aspect of the present disclosure, there is provided an apparatus for backlight black frame insertion optimization. The apparatus is applied to a wearable smart device. The apparatus includes: a display mode acquiring module configured to acquire a current display mode of the wearable smart device; a motion state acquiring module configured to acquire a current motion state of the wearable smart device; and a black frame insertion optimization module configured to adjust backlight black frame insertion of the wearable smart device according to the current display mode and the current motion state.

According to a fourth aspect of the present disclosure, there is provided a computer-readable medium, storing a computer program thereon. The program is executable by the processor, whereby the method for backlight black frame insertion optimization according to any one of the above embodiments is implemented.

According to a fifth aspect of the present disclosure, there is provided an electronic device, which includes: at least one processor; and a storage apparatus configured to store at least one program. At least one program is executable by the at least one processor, whereby at least one processor is configured to implement the method for backlight black frame insertion optimization according to any one of the above embodiments.

It is to be understood that the above general description and the detailed description below are merely exemplary and explanatory and do not limit the present disclosure.

BRIEF DESCRIPTION OF THE DRAWINGS

The accompanying drawings herein are incorporated in and constitute a part of this specification, illustrate embodiments conforming to the present disclosure, and, together with the description, serve to explain the principles of the present disclosure. It should be noted that the accompanying drawings in the following description show merely some embodiments of the present disclosure, and persons of ordinary skill in the art may still derive other drawings from these accompanying drawings without creative efforts.

DETAILED DESCRIPTION

Figure 1:
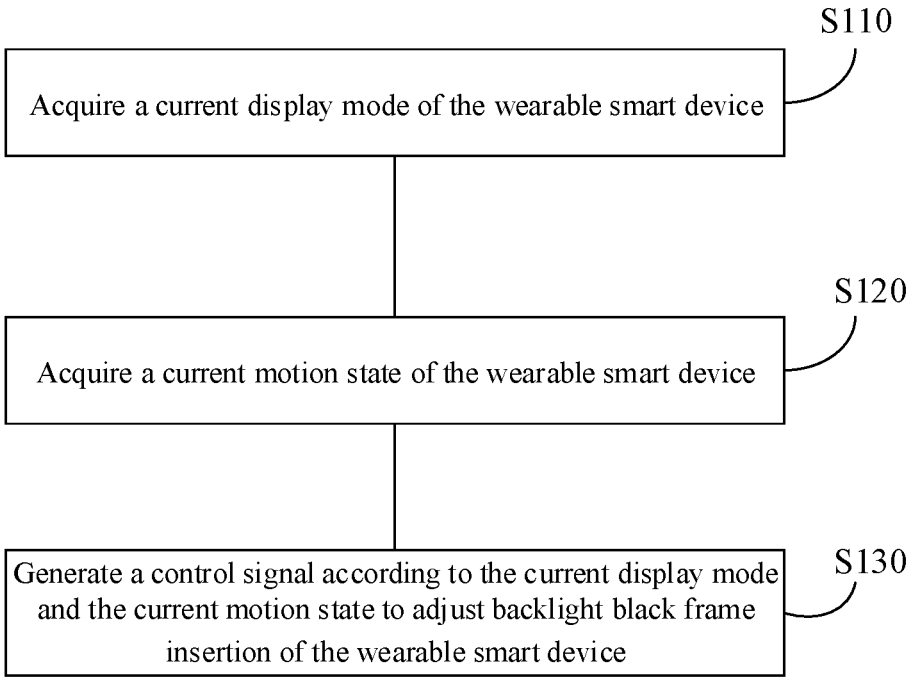
FIG. 1 schematically illustrates a flowchart of a method for backlight black frame insertion optimization according to an exemplary embodiment of the present disclosure.

Exemplary embodiments will be described more comprehensively by referring to accompanying drawings now. However, the exemplary embodiments can be embodied in many forms and should not be construed as limited to the embodiments set forth herein. Rather, these embodiments are provided so that this disclosure will be made thorough and complete, and the concept of exemplary embodiments will be fully conveyed to those skilled in the art. Furthermore, the described features, structures, or characteristics may be combined in any suitable manner in one or more embodiments.

In addition, the accompanying drawings are merely exemplary illustration of the present disclosure, and are not necessarily drawn to scale. The same reference numerals in the drawings denote the same or similar parts, and thus repeated description thereof will be omitted. Some block diagrams shown in the figures are functional entities and not necessarily to be corresponding to a physically or logically individual entities. These functional entities may be implemented in software form, implemented in one or more hardware modules or integrated circuits, or implemented in different networks and/or processor apparatuses and/or microcontroller apparatuses.

In the related art, a full black frame may be inserted between two adjacent frames or a plurality of frames in a liquid crystal display device to achieve the effect of increasing the total number of frames, such that a picture having afterimage becomes clear. However, this black frame insertion method requires that the response time of the liquid crystal display is fast enough, and the maximum duration of the black frame insertion response time is almost 8 ms. When a black frame is inserted beyond this time, it is easily perceived by the human eye, and a flicker may occur.

Therefore, in the related technologies, another black frame insertion method is also used to achieve the same objective: the insertion of full black screen is implemented by turning off the backlight lamp when appropriate. Using this method, the black frame insertion is implemented and is not affected by the liquid crystal response time, which may eliminate the phenomenon of visual persistence without causing perceptible flicker.

However, it is found that if the backlight is controlled to be continuously turned on or off, in one aspect, the brightness of the display may be reduced to a certain extent, and in another aspect, the backlight LED (Light-Emitting Diode) is turned on and off more frequently. A transient overcurrent may be easily generated at the moment when the LED is turned on. The transient overcurrent is several times of a normal working current, which may lead to a decrease in the service life of the LED and may cause greater interference to the power supply of the whole machine. In addition, turning the backlight lamp on and off frequently may increase the power consumption of the whole machine.

FIG. 1 schematically illustrates a flowchart of a method for backlight black frame insertion optimization according to an exemplary embodiment of the present disclosure. The method may be used in a wearable smart device.

In some embodiments of the present disclosure, the wearable smart device may be a virtual reality (VR) device. It is to be noted that in following embodiments, although the VR device is taken as an example for illustration, the present disclosure is not limited thereto. The wearable smart device may be any type of smart wearable device, such as an augmented reality (AR) device, a smart watch, a smart helmet, etc.

As shown in FIG. 1, the method for backlight black frame insertion optimization provided by the embodiments of the present disclosure may include the following steps.

In Step S110, a current display mode of the wearable smart device is acquired.

In the embodiments of the present disclosure, an application is installed in the wearable smart device, and the current display mode may refer to a usage state in which the application is. For example, when the wearable smart device is a VR device, the application may be in a 2 dimension (2D) display mode (also known as a 2D cinema mode) or a non-2D display mode.

In Step S120, a current motion state of the wearable smart device is acquired.

In the embodiments of the present disclosure, the wearable smart device may be in a continuous motion state or a non-continuous motion state. The continuous motion state may be defined according to a specific application scenario. For example, when the wearable smart device is a VR device, a user wears a VR helmet display. The VR device is in the continuous motion state when the user's head keeps rotating. When the user's head is in a state of rest, or the user's head occasionally rotates instead of continuously rotating, it may be believed that the VR device is in the non-continuous motion state.

In Step S130, a control signal is generated according to the current display mode and the current motion state to adjust backlight black frame insertion of the wearable smart device.

In the embodiments of the present disclosure, the control signal may include a first control signal and a second control signal. When the wearable smart device is in the non-2D display mode and is in the continuous motion state, the first control signal may be transmitted to control a backlight of the wearable smart device to perform black insertion. When the wearable smart device is in the 2D display mode, or when the wearable smart device is in the 2D display mode, but is in the non-continuous motion state, the second control signal may be transmitted to control the backlight of the wearable smart device to not perform black insertion.

According to the method for backlight black frame insertion optimization provided by some embodiments of the present disclosure, whether it is required to perform backlight black frame insertion currently may be determined according to the motion state and the display mode of the wearable smart device, such that backlight black frame insertion optimization may be performed. In this way, the number of times of turning on/off a backlight lamp of the backlight can be reduced.

Figure 2:
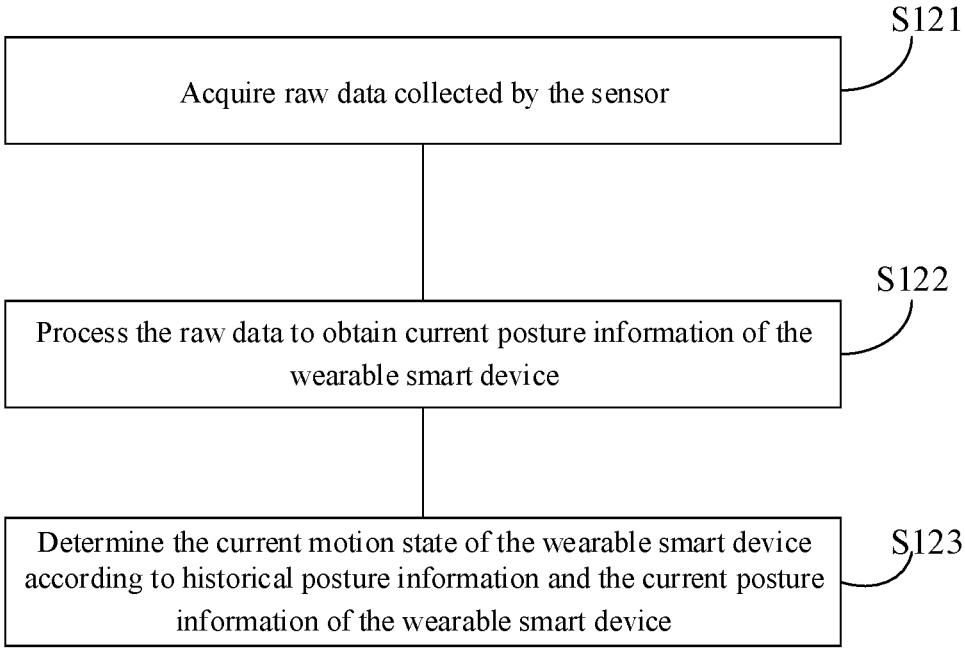
FIG. 2 illustrates a processing procedure chart of Step S120 in FIG. 1 according to an exemplary embodiment.

FIG. 2 illustrates a processing procedure chart of Step S120 in FIG. 1 according to an exemplary embodiment.

In some embodiments of the present disclosure, the wearable smart device may include a sensor. For example, the sensor may include a gyroscope, an accelerometer, and a geomagnetic sensor, but the present disclosure is not limited thereto. As shown in FIG. 2, the Step S120 in the embodiments of the present disclosure may further include following steps.

In Step S121, raw data (also referred to as bare data, i.e., data collected directly by the sensor and not processed yet) is collected by the sensor and acquired.

In Step S122, the raw data is processed to obtain current posture information of the wearable smart device.

In some embodiments of the present disclosure, a quaternion may be obtained by performing posture fusion processing on the raw data collected by the sensor. Then, the quaternion is converted into an Euler angle, and the Euler angle is determined as the current posture information, but the present disclosure is not limited thereto.

In Step S123, the current motion state of the wearable smart device is determined according to historical posture information and the current posture information of the wearable smart device.

In some embodiments of the present disclosure, the current motion state may be determined by comparing the historical posture information with the current posture information. The current motion state may include a continuous motion state and a non-continuous motion state.

Figure 3:
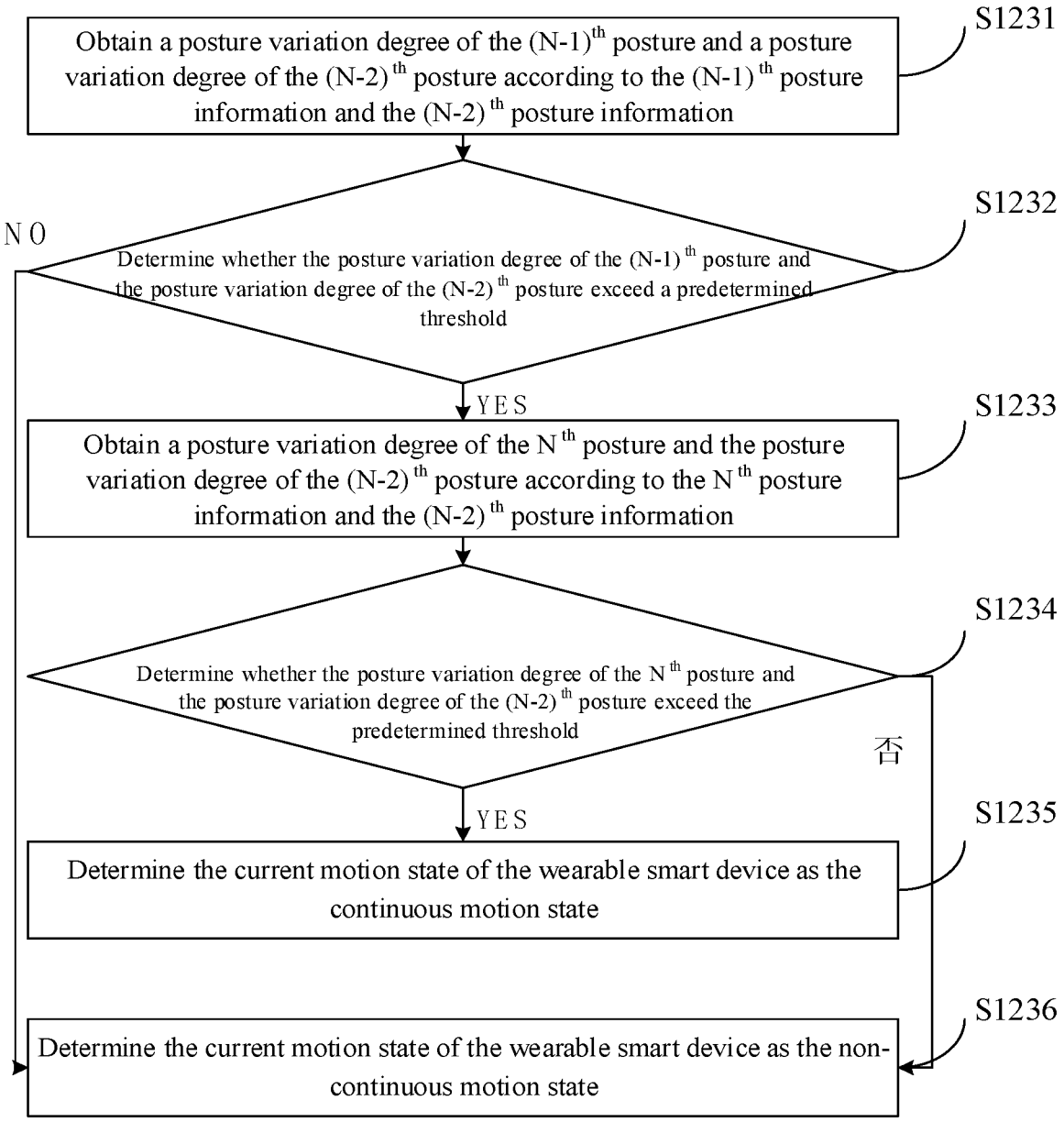
FIG. 3 illustrates a processing procedure chart of Step S123 in FIG. 2 according to an exemplary embodiment.

FIG. 3 illustrates a processing procedure chart of Step S123 in FIG. 2 according to an exemplary embodiment.

As shown in FIG. 3, the Step S123 in the embodiments of the present disclosure may further include following steps. Herein, supposing the current posture information is $N^{th}$ posture information, the historical posture information may include $(N-1)^{th}$ posture information and $(N-2)^{th}$ posture information, wherein N is a positive integer greater than or equal to 3.

In Step S1231, a posture variation degree of the $(N-1)^{th}$ posture and a posture variation degree of the $(N-2)^{th}$ posture are obtained according to the $(N-1)^{th}$ posture information and the $(N-2)^{th}$ posture information.

In Step S1232, it is determined whether the posture variation degree of the $(N-1)^{th}$ posture and the posture variation degree of the $(N-2)^{th}$ posture exceed a predetermined threshold. Step S1233 is proceeded to if the posture variation degree of the $(N-1)^{th}$ posture and the posture variation degree of the $(N-2)^{th}$ posture exceed the predetermined threshold. Otherwise, Step S1236 is proceeded to.

The predetermined threshold may be preset according to specific application scenarios, which is not limited in the present disclosure.

In Step S1233, a posture variation degree of the $N^{th}$ posture and the posture variation degree of the $(N-2)^{th}$ posture are obtained according to the $N^{th}$ posture information and the $(N-2)^{th}$ posture information.

In Step S1234, it is determined whether the posture variation degree of the $N^{th}$ posture and the posture variation degree of the $(N-2)^{th}$ posture exceed the predetermined threshold. Step S1235 is proceeded to if the posture variation degree of the $N^{th}$ posture and the posture variation degree of the $(N-2)^{th}$ posture exceed the predetermined threshold. Otherwise, Step S1236 is proceeded to.

In Step S1235, the current motion state of the wearable smart device is determined as the continuous motion state.

In some embodiments of the present disclosure, the posture variation degree of the $(N-1)^{th}$ posture and the posture variation degree of the $(N-2)^{th}$ posture are obtained according to the $(N-1)^{th}$ posture information and the $(N-2)^{th}$ posture information. The posture variation degree of the $N^{th}$ posture and the posture variation degree of the $(N-2)^{th}$ posture are continued to be obtained according to the $N^{th}$ posture information and the $(N-_2)^{th}$ posture information if the posture variation degree of the $(N-1)^{th}$ posture and the posture variation degree of the $(N-2)^{th}$ posture do not exceed the predetermined threshold. Otherwise, the current motion state of the wearable smart device is determined as the continuous motion state.

In Step S1236, the current motion state of the wearable smart device is determined as the non-continuous motion state.

In some embodiments of the present disclosure, the current motion state of the wearable smart device is determined as the non-continuous motion state if the posture variation degree of the $(N-1)^{th}$ posture and the posture variation degree of the $(N-2)^{th}$ posture do not exceed the predetermined threshold or if the posture variation degree of the $N^{th}$ posture and the posture variation degree of the $(N-2)^{th}$ posture do not exceed the predetermined threshold.

Figure 4:
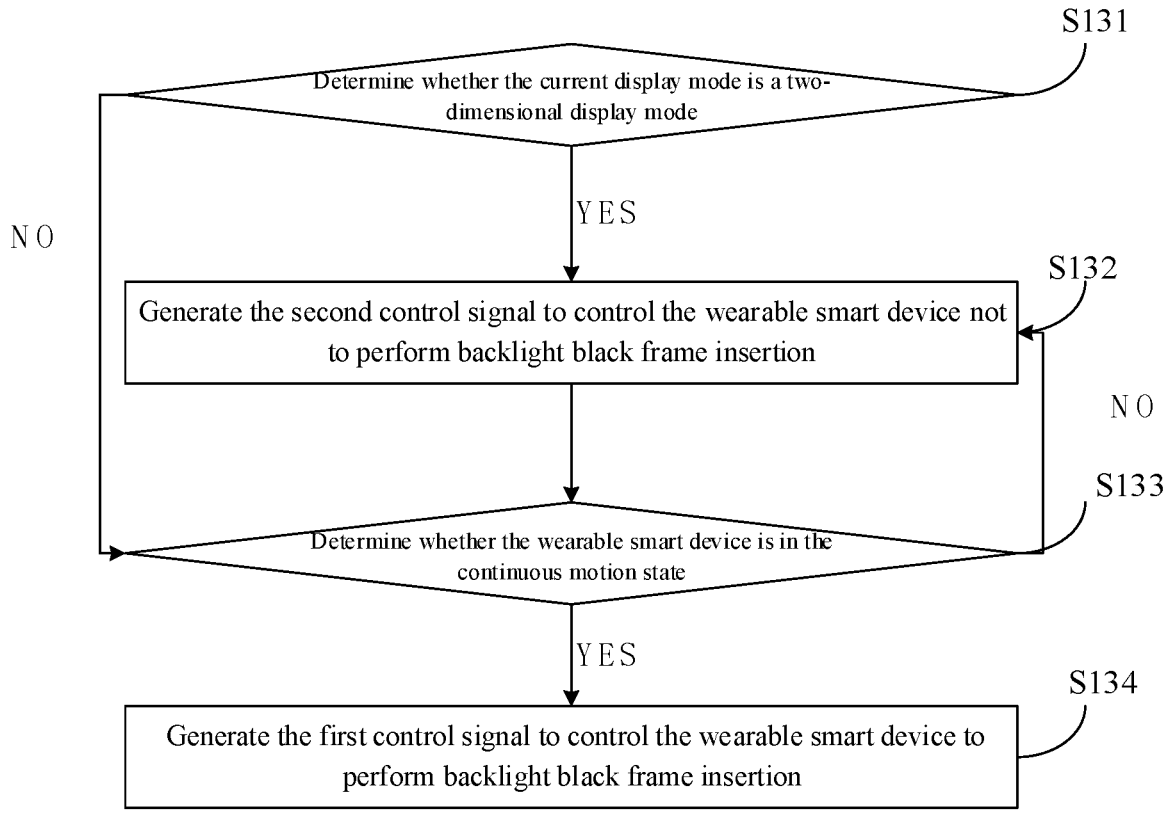
FIG. 4 illustrates a processing procedure chart of Step S130 in FIG. 1 according to an exemplary embodiment.

FIG. 4 illustrates a processing procedure chart of Step S130 in FIG. 1 according to an exemplary embodiment.

As shown in FIG. 4, the Step S130 in the embodiments of the present disclosure may further include following steps.

In Step S131, it is determined whether the current display mode of the wearable smart device is a two-dimensional display mode. Step S132 is proceeded to if the current display mode is the two-dimensional display mode. Step S133 is proceeded to if the current display mode is the non-two-dimensional display mode.

In Step S132, the second control signal is generated to control the wearable smart device not to perform backlight black frame insertion.

In the embodiments of the present disclosure, if the current display mode is the two-dimensional display mode, or if the current display mode is the non-two-dimensional display mode, and the wearable smart device is in the non-continuous motion state, the second control signal is generated to control the wearable smart device not to perform backlight black frame insertion.

In Step S133, it is determined whether the wearable smart device is in the continuous motion state. Step S134 is proceeded to if the wearable smart device is in the continuous motion state. Step S132 is jumped back to if the wearable smart device is in the non-continuous motion state.

In Step S134, the first control signal is generated to control the wearable smart device to perform backlight black frame insertion.

In the embodiments of the present disclosure, the first control signal is generated to control the wearable smart device to perform backlight black frame insertion if the current display mode is the non-two-dimensional display mode and the wearable smart device is in the continuous motion state.

Figure 5:
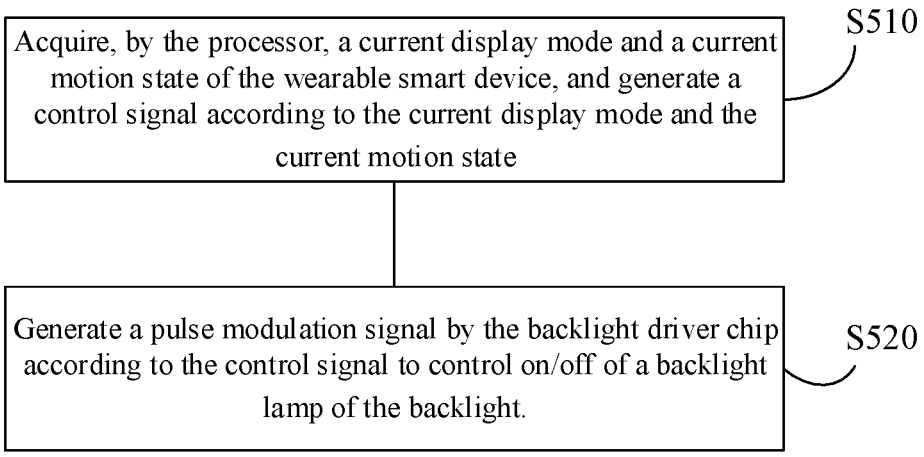
FIG. 5 schematically illustrates a flowchart of another method for backlight black frame insertion optimization according to an exemplary embodiment of the present disclosure.

FIG. 5 schematically illustrates a flowchart of another method for backlight black frame insertion optimization according to an exemplary embodiment of the present disclosure. The method may be applied to a wearable smart device, which may include a processor, a backlight driver chip, and a backlight.

As shown in FIG. 5, the method for backlight black frame insertion optimization provided by the embodiments of the present disclosure may include following steps.

In Step S510, the processor acquires a current display mode and a current motion state of the wearable smart device and generates a control signal according to the current display mode and the current motion state.

In an exemplary embodiment, the wearable smart device may further include a sensor, and the processor may include a kernel layer, a native layer, and an application layer.

Acquiring, by the processor, a current motion state of the wearable smart device may include: transferring raw data of the wearable smart device collected by the sensor to the native layer through the kernel layer; obtaining a quaternion by performing data fusion on the native layer, converting the quaternion into an Euler angle, and sending the Euler angle to the application layer; and obtaining, by the application layer, the current motion state of the wearable smart device according to the Euler angle.

In an exemplary embodiment, the wearable smart device may further include a backlight controller. Generating, by the processor, a control signal according to the current display mode and the current motion state may include: generating, by the application layer, the control signal according to the current display mode and the current motion state; and sending, by the application layer, the control signal to the backlight controller via the native layer and the kernel layer sequentially.

In Step S520, the backlight driver chip generates a pulse modulation signal according to the control signal to control on/off of a backlight lamp of the backlight.

In an exemplary embodiment, the control signal includes a first control signal and a second control signal.

Generating a pulse modulation signal by the backlight driver chip according to the control signal to control on/off of a backlight lamp of the backlight may include: parsing the control signal and sending the same to the backlight driver chip by the backlight controller; generating, by the backlight driver chip, a pulse modulation signal having a predetermined duty cycle to alternately turn on and off the backlight lamp if the control signal is the first control signal; and generating a DC signal by the backlight driver chip to continuously turn on the backlight lamp if the control signal is the second control signal.

Figure 6:
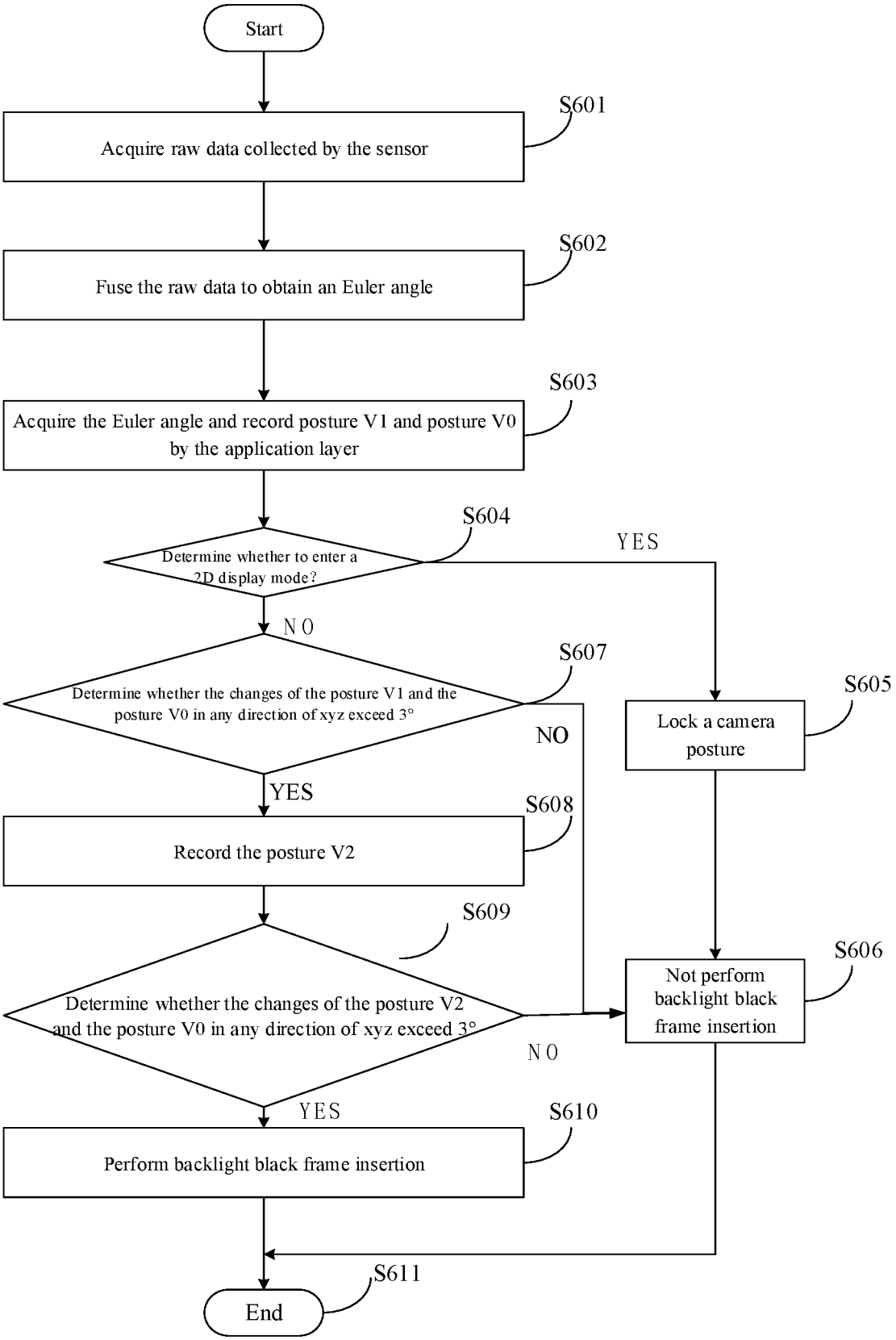
FIG. 6 schematically illustrates a flowchart of still another method for backlight black frame insertion optimization according to an exemplary embodiment of the present disclosure.

FIG. 6 schematically illustrates a flowchart of still another method for backlight black frame insertion optimization according to an exemplary embodiment of the present disclosure.

As shown in FIG. 6, the method for backlight black frame insertion optimization provided by the embodiments of the present disclosure may include following steps.

In Step S601, raw data is collected by the sensor are acquired.

In the embodiments of the present disclosure, taking a VR device as an example, the processor of the VR device may first acquire the raw data from the sensor through an $I^2C$ bus (Inter-Integrated Circuit, the $I^2C$ bus is a bidirectional two-wire synchronous serial bus, which only needs two wires to transfer information between devices connected to the bus).

In Step S602, the raw data is fused to obtain an Euler angle.

In the embodiments of the present disclosure, the native layer in the processor of the VR device may perform posture fusion on the raw data to obtain a quaternion and convert the quaternion into the Euler angle. The Euler angle may include a pitch angle, a roll angle, and a yaw angle.

In Step S603, the application layer acquires the Euler angle and records the posture V1 and the posture V0.

In the embodiments of the present disclosure, the application layer in the processor of the VR device may read the Euler angle from the native layer and record the Euler angle as the current posture V0 of the VR device. By using a similar method, the posture V1 of the VR device at the previous moment may be pre-stored.

In Step S604, it is determined whether or not the 2D display mode (or 2D cinema mode) is entered. Step S605 is proceeded to if the 2D display mode is entered, otherwise S607 is proceeded to.

In the embodiments of the present disclosure, it is subsequently determined whether the current display mode of the VR device is the 2D cinema mode. The 2D cinema mode refers to a display mode having a planar viewing effect, whereas the non-2D display mode refers to a display mode that enables a viewer to have an immersive viewing effect, such as a 180° half-cycle viewing mode and a 360° panoramic viewing mode.

In Step S605, the posture of a camera is locked.

The camera here is a virtual camera in the scene, and the posture of the sensor is the same as that of the virtual camera.

In Step S606, backlight black frame insertion is not performed.

In the embodiments of the present disclosure, if the current display mode of the VR device is the 2D cinema mode, the posture of the camera of the VR device may be directly locked. Although the VR helmet display device of the VR device may change the position of the display screen in real time as the user's head moves, the display screen may be locked in front of the viewers, with a better viewing effect. In this case, backlight black frame insertion may be not performed, even if the backlight PWM duty cycle is increased to 100%.

In Step S607, it is determined whether the changes of the posture V1 and the posture V0 in any direction of xyz exceed 3°. Step S608 is proceeded to if the changes of the posture V1 and the posture V0 in any direction of xyz exceed 3°. Otherwise, Step S606 is returned to, and then Step S611 is proceeded to.

Specifically, the xyz is a world coordinate system (also referred to as an earth surface inertial coordinate system), which may be used to study the motion state of the VR device with respect to the ground, and determine spatial position coordinates of the VR device. The curvature of the Earth is ignored, i.e., the surface of the Earth is assumed to be a plane. One point on the ground is selected as a starting position of the VR device. For a body coordinate system of the VR device, its origin is located at the center of gravity of the VR device, and the coordinate system is fixed to the VR device. An included angle between the body coordinate system and the earth surface inertial coordinate system is a posture angle of the VR device, which is also known as the Euler angle.

The pitch angle is the included angle between a body axis and the ground plane (horizontal plane). The yaw angle is the included angle between a projection of the body axis on the horizontal plane and an axis of the Earth. The roll angle is an angle at which a symmetry plane of the VR device rotates around the body axis.

In Step S608, a posture V2 may be recorded.

In the embodiments of the present disclosure, the posture V2 may refer to postures at the first two moments with respect to the current moment. Each of the historical postures may be prestored and may be retrieved when it is required to make a comparison.

In Step S609, it is determined whether the changes of the posture V2 and the posture V0 in any direction of the xyz exceed 3°. Step S610 is proceeded to if the changes of the posture V2 and the posture V0 in any direction of the xyz exceed 3°. Otherwise, Step S606 is returned to, and then, Step S611 is proceeded to.

It is to be noted that the above predetermined threshold is set as the change of any one of the three angles of the Euler angle exceeding 3°, but the present disclosure is not limited thereto, and the predetermined threshold may be determined based on a field test. In addition, the changes of any two of the three angles or all the three angles of the Euler angle may be preset to be more than a predetermined degree.

In Step S610, backlight black frame insertion is not performed.

In the embodiments of the present disclosure, the posture variation degree of the posture V1 and the posture variation degree of the posture V0 are determined if the current display mode of the VR device is not the 2D cinema mode. The posture V2 is recorded once again if the changes in any one of three directions of the xyz exceed 3°, and then, the posture variation degree of the posture V2 and the posture variation degree of the posture V0 are determined again. If the changes in any one of the three directions of the xyz still exceed 3°, this indicates that the head of the user wearing the VR device is continuously moving, and in this case, it is controlled to perform backlight black frame insertion. That is, it is determined whether the VR device keeps moving by comparing continuous posture data.

It is to be noted that the angle 3° as mentioned in this embodiment is an empirical value for the purpose of illustration, and the angle may be adjusted and designed according to specific application scenarios and actual needs, which is not limited in the present disclosure.

In the embodiments of the present disclosure, the black frame insertion time per frame is fixed. The longer the operation duration of the VR device is, the larger the number of black frame insertions is.

In Step S611, the operation is ended.

According to the method for backlight black frame insertion optimization provided by the embodiments of the present disclosure, the state backlight black frame insertion may be adjusted at any time according to the state of the application and the posture of the user's head. That is, when the application is in the 2D cinema mode, i.e., when the user's head keeps moving, the camera position may still be locked, and black frame insertion may be not performed at this moment. Alternatively, when the application is in the non-2D cinema mode but the user's head is close to a static posture, black frame insertion may also be not performed at this moment. Thus, in one aspect, the number of times of turning on/off a backlight lamp may be reduced, such that the service life of the backlight lamp may be prolonged, the power consumption may be reduced, and interference to the power supply of the whole machine may be reduced. In another aspect, the brightness of the backlight may be improved to some extent.

Figure 7:
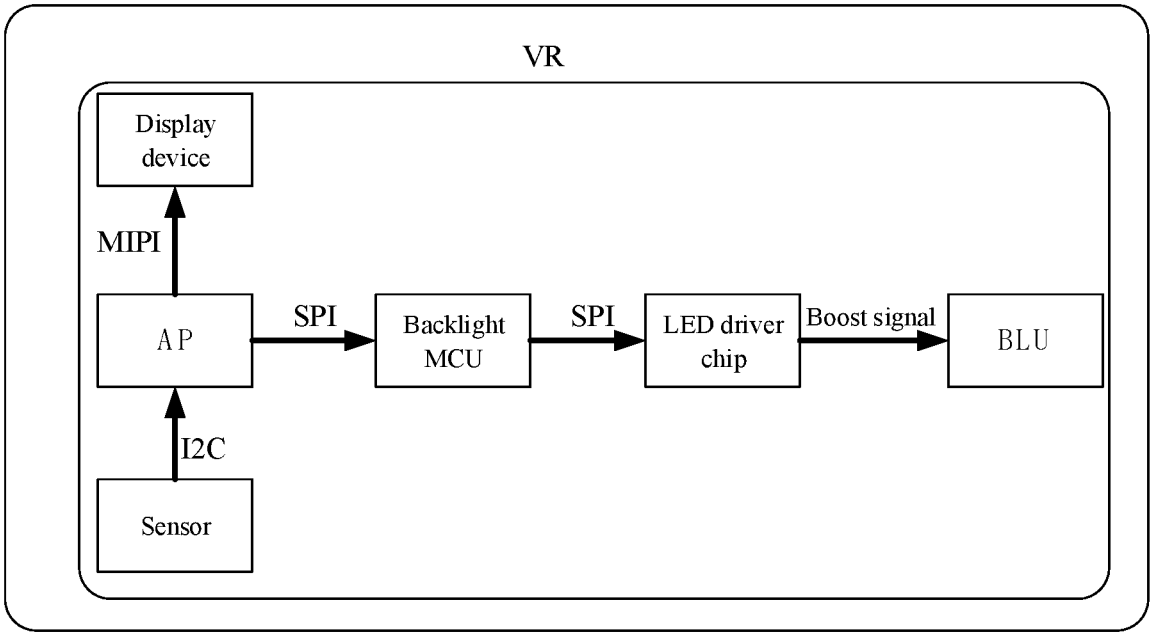
FIG. 7 schematically illustrates a schematic diagram of a hardware structure of a VR device according to an exemplary embodiment of the present disclosure.

FIG. 7 schematically illustrates a schematic diagram of a hardware structure of a VR device according to an exemplary embodiment of the present disclosure. Herein, the VR device is taken as an example for description.

As shown in FIG. 7, the VR device may include a sensor, an application processor (AP processor), i.e., the above processor, a display device (for example, a liquid crystal display device), a backlight microcontroller unit (MCU), i.e., the above backlight controller, an LED driver (i.e., the above backlight driver chip), and a black light unit (BLU), which is a light source located on the non-display side of the liquid crystal display, wherein the light emission effect of the BLU directly affects the visual effect of the liquid crystal display module. The liquid crystal display itself does not emit light, figures, or characters shown by the liquid crystal display are resulted from its modulation of light).

Data is transmitted between the sensor and the AP processor through $I^2C$, data is transmitted between the AP processor and the display device through Mobile Industry Processor Interface (MIPI), and data is transmitted between the AP processor and the backlight MCU and between the backlight MCU and the LED driver through Serial Peripheral Interface (SPI), and a boost signal is transmitted to the BLU by the LED driver.

Specifically, the AP processor may read sensor bare data through the $I^2C$, process the sensor bare data, obtain a quaternion by fusing, and convert the quaternion into an Euler angle, thereby determining the current motion state of the VR device according to the Euler angle. The AP processor may also acquire a current display mode of the VR device, then generate a control signal according to the current display mode and the current motion state, and then transmit the control signal to the backlight MCU through the SPI. The backlight MCU parses the control signal transmitted by the AP processor and transmits the control signal to the LED driver, such that the LED driver performs PWM conversion according to the control signal to control a brightness value of each backlight lamp of the backlight, including the duty cycle of a PWM signal in each cycle.

Continuing referring to FIG. 7, the AP processor may also transmit the display data to the display device through Mobile Industry Processor Interface (MIPI).

Figure 8:
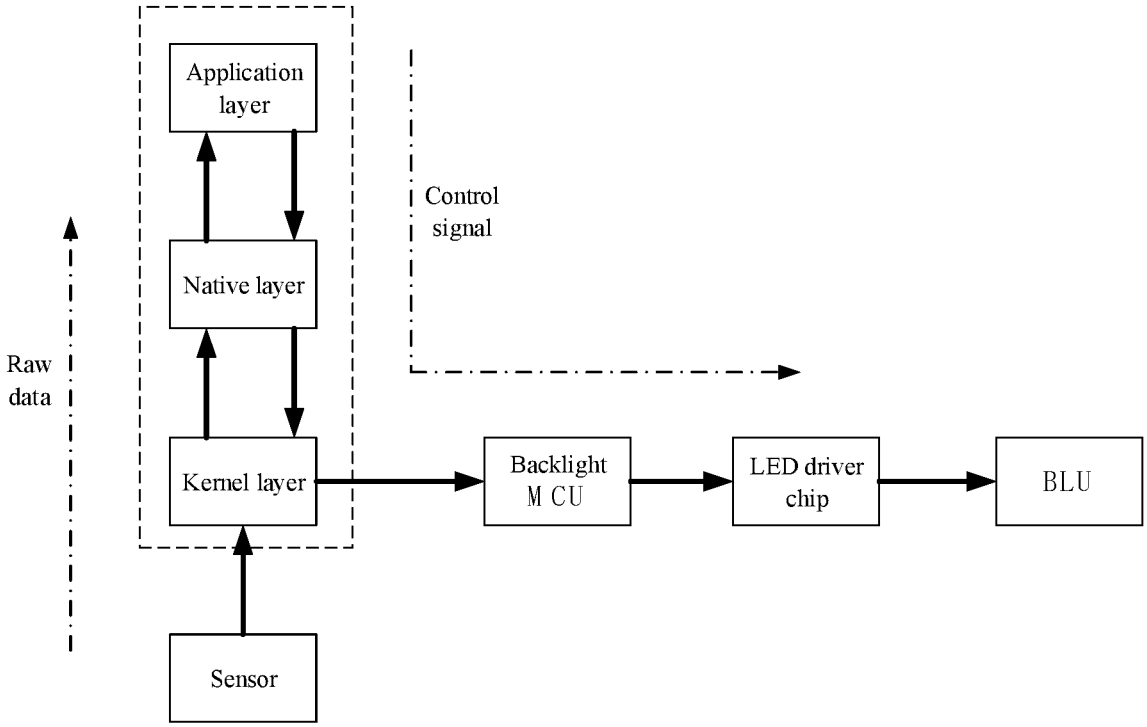
FIG. 8 schematically illustrates a data transmission flowchart according to an exemplary embodiment of the present disclosure.

FIG. 8 schematically illustrates a data transmission flowchart according to an exemplary embodiment of the present disclosure.

As shown in FIG. 8, the raw data collected by the sensor are transmitted to a native layer through a kernel layer of the AP processor, and the native layer fuses the raw data to obtain a quaternion and converts the quaternion into an Euler angle. An application layer acquires the Euler angle using the same method as the native layer and generates a control signal. Next, the application layer transmits the control signal to the backlight MCU via the native layer and the kernel layer sequentially through the SPI. The backlight MCU parses the control signal and transmits the parsed control signal to the LED driver, such that the LED driver transmits the PWM to the BLU.

The native layer includes some native services and some link libraries, etc. One feature of the native layer is that services may be implemented in C and C++ languages. For example, it is inefficient in implementing a complex operation by a Java code. In this case, it may be selected to implement the complex operation by a C or C++ code, and then, the C or C++ code may communicate with a high-level Java code (which is called a jni (Java Native Interface) mechanism in Android). As another example, if a device needs to run, the device needs to interact with an underlying hardware driver, which also needs to be implemented through the native layer.

In the embodiments of the present disclosure, the raw data collected by the sensor is processed at the native layer, and the fused posture data is transmitted to the application layer. In this way, the efficiency of data calculating and processing may be improved.

Since the LED driver itself is a boost chip, the boost signal in the figure may be, for example, 5V in input. However, a voltage of about 32V is needed to output a voltage for controlling the backlight, so the voltage needs to be boosted.

Figure 9:
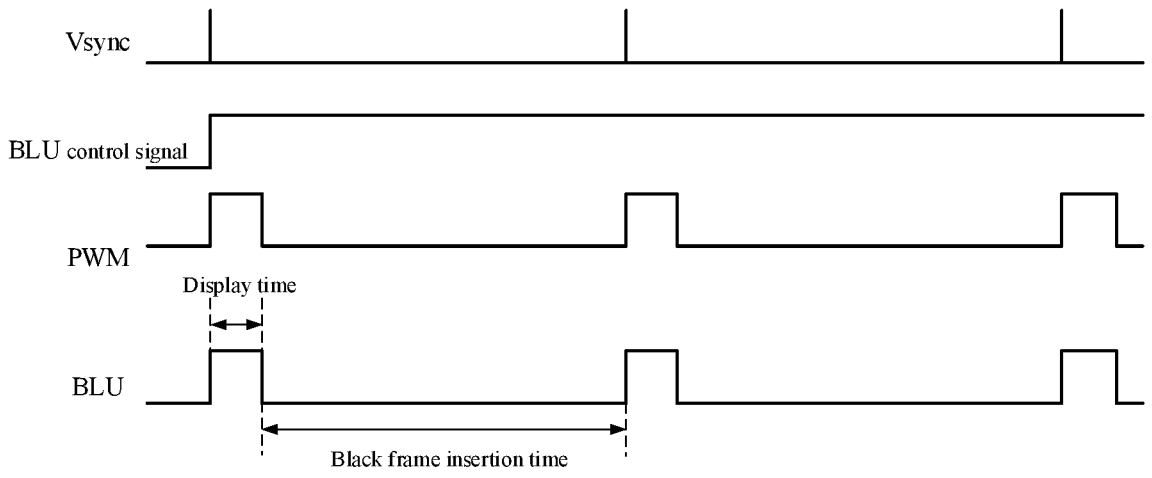
FIG. 9 illustrates a timing diagram of a control signal for normal backlight black frame insertion in related technologies.

FIG. 9 illustrates a timing diagram of a control signal for normal backlight black frame insertion in related technologies.

As shown in FIG. 9, the control signal may include a Vsync synchronization signal, a BLU control signal, a PWM signal, and a BLU, wherein the BLU may include display time and black frame insertion time.

Specifically, in the normal backlight black frame insertion control, the BLU control signal is maintained at a high level, and the PWM signal is periodically repeated. When the BLU control signal and the PWM signal are simultaneously at a high level, the backlight lamp such as a backlight LED is turned on. The backlight LED is turned off when the PWM signal at a low level.

Therefore, the display time in one frame is only the time of the PWM high level, the display brightness is lower, and the backlight LED is turned on and off frequently, which seriously affects the service life of the LED. Meanwhile, a transient overcurrent may be easily generated at the moment when the LED is turned on. The transient overcurrent is usually several times of a normal working current, which may increase the overall power consumption of the VR and cause great interference to the overall power consumption, thus having a certain negative effect on the working stability of the VR.

Figure 10:
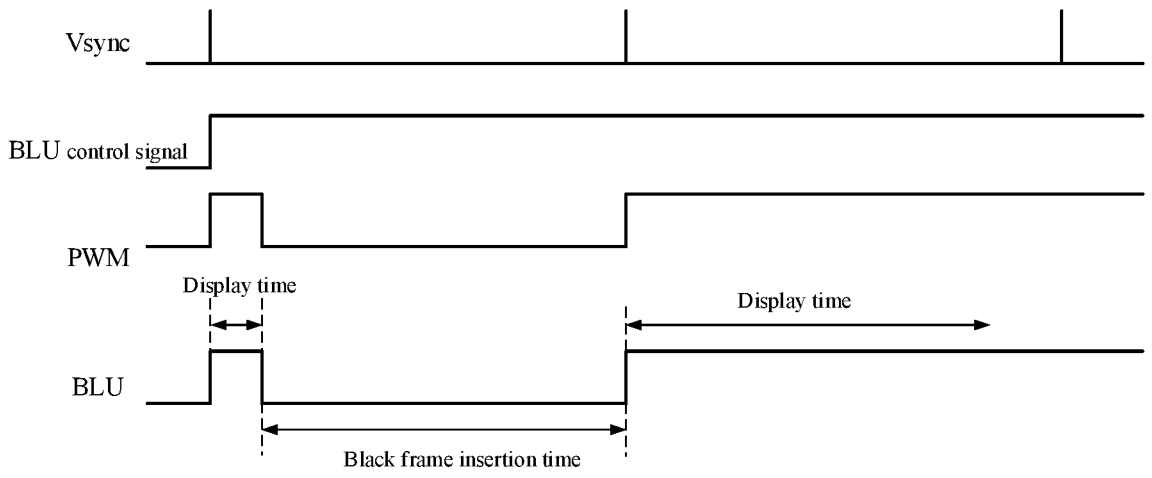
FIG. 10 schematically illustrates a timing diagram of a control signal subject to backlight black frame insertion optimization according to an exemplary embodiment of the present disclosure.
Figure 11:
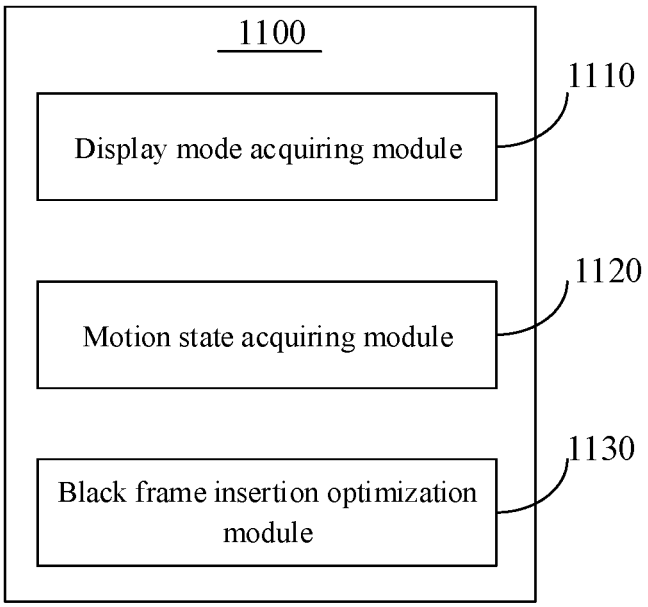
FIG. 11 schematically illustrates a schematic constitutional diagram of an apparatus for backlight black frame insertion optimization according to an exemplary embodiment of the present disclosure.

FIG. 10 schematically illustrates a timing diagram of a control signal subject to backlight black frame insertion optimization according to an exemplary embodiment of the present disclosure.

FIG. 10 shows the backlight control process processed by using the method for backlight black frame insertion optimization provided by the embodiments of the present disclosure, which also includes a Vsync synchronization signal, a BLU control signal, a PWM signal, and a BLU, wherein the BLU includes display time and black frame insertion time. The actual BLU may be obtained by performing and operation on the PWM signal and the BLU control signal.

Specifically, compared with FIG. 9, the BLU control signal remains unchanged and is maintained at a high level. The PWM signal continues to maintain at a high level when the PWM signal is in the 2D display mode or the helmet display device of the VR device is close to a static posture. Thus, in some intervals, the backlight is maintained at an ON state. Therefore, the number of times of turning on and off the backlight is effectively reduced, the brightness of the backlight is improved to a certain extent, and the service life of the backlight LED is greatly prolonged. Furthermore, the transient overcurrent is reduced, the interference to the power supply of the whole machine is also greatly reduced, and the stability of the VR machine is improved.

It is to be noted that the above accompanying drawings are merely illustrative description of processes included in the method according to the exemplary embodiments of the present disclosure and are not intended to limit the present disclosure. It is easy to understand that the processes shown in the above accompanying drawings do not indicate or limit time sequences of these processes. Furthermore, it is also easy to understand that these processes may be executed, for example, synchronously or asynchronously in a plurality of modules.

Further, this exemplary embodiment also provides an apparatus 1100 for backlight black frame insertion optimization, which may include a display mode acquiring module 1110, a motion state acquiring module 1120, and a black frame insertion optimization module 1130. The apparatus may be used in a wearable smart device.

The display mode acquiring module 1110 may be configured to acquire a current display mode of the wearable smart device.

The motion state acquiring module 1120 may be configured to acquire a current motion state of the wearable smart device.

The black frame insertion optimization module 1130 may be configured to adjust backlight black frame insertion of the wearable smart device according to the current display mode and the current motion state.

In an exemplary embodiment, the wearable smart device includes a sensor, and the motion state acquiring module 1120 may include: a sensor data acquiring submodule, which may be configured to acquire raw data collected by the sensor; a sensor data processing submodule, which may be configured to process the raw data to obtain current posture information of the wearable smart device; and a motion state determining submodule, which may be configured to determine the current motion state of the wearable smart device according to historical posture information and the current posture information of the wearable smart device. The current motion state includes a continuous motion state and a non-continuous motion state.

In an exemplary embodiment, the control signal may include a first control signal. The black frame insertion optimization module 1130 may include a first control signal generating submodule, which may be configured to generate the first control signal to control the wearable smart device to perform backlight black frame insertion if the current display mode is a non-two-dimensional display mode and the wearable smart device is in the continuous motion state.

In an exemplary embodiment, the control signal may include a second control signal. The black frame insertion optimization module 1130 may include a second control signal generating submodule, which may be configured to generate the second control signal to control the wearable smart device not to perform backlight black frame insertion if the current display mode is a two-dimensional display mode or if the current display mode is a non-two-dimensional display mode and the wearable smart device is in the non-continuous motion state.

In an exemplary embodiment, the current posture information is $N^{th}$ posture information, and the historical posture information includes $(N-1)^{th}$ posture information and $(N-2)^{th}$ posture information, wherein N is a positive integer greater than or equal to 3.

The motion state determining submodule may include: a first posture variation obtaining unit, which may be configured to obtain a posture variation degree of the $(N-1)^{th}$ posture and a posture variation degree of the $(N-2)^{th}$ posture according to the $(N-1)^{th}$ posture information and the $(N-2)^{th}$ posture information; a second posture variation obtaining unit, which may be configured to obtain a posture variation degree of the $N^{th}$ posture and the posture variation degree of the $(N-2)^{th}$ posture according to the $N^{th}$ posture information and the $(N-2)^{th}$ posture information if the posture variation degree of the $(N-1)^{th}$ posture and the posture variation degree of the $(N-2)^{th}$ posture exceed a predetermined threshold; and a first motion state determining unit, which may be configured to determine the current motion state of the wearable smart device as the continuous motion state if the posture variation degree of the $N^{th}$ posture and the posture variation degree of the $(N-2)^{th}$ posture exceed the predetermined threshold.

In an exemplary embodiment, the motion state determining submodule may further include a second motion state determining unit, which may be configured to determine the current motion state of the wearable smart device as the non-continuous motion state if the posture variation degree of the $(N-1)^{th}$ posture and the posture variation degree of the $(N-2)^{th}$ posture do not exceed the predetermined threshold or if the posture variation degree of the $N^{th}$ posture and the posture variation degree of the $(N-2)^{th}$ posture do not exceed the predetermined threshold.

The display mode acquiring module, the motion state acquiring module, the black frame insertion optimization module, the first control signal generating submodule, the second control signal generating submodule and the motion state determining submodule described above may be program unit that can be executed by the processor, or a chip capable of implementing the above operation steps.

With regard to the apparatus in the above embodiments, specific implementations for executing operations by modules thereof have been described in detail in the embodiments related to the method and thus are not elaborated herein.

It is to be noticed that although a plurality of modules or units of the device for action execution have been mentioned in the above detailed description, this partition is not compulsory. Actually, according to the embodiments of the present disclosure, features and functions of two or more modules or units as described above may be embodied in one module or unit. Conversely, features and functions of one module or unit as described above may be further embodied in more modules or units. The parts described as modules or units may or may not be physical units, i.e., either located at one place or distributed on a plurality of network units. Modules may be selected in part or in whole according to the actual needs to implement the objective of the solution of the present disclosure. Those of ordinary skill in the art may comprehend and implement the embodiments without contributing creative effort.

In an exemplary embodiment of the present disclosure, there is further provided an electronic device capable of implementing the above method for backlight black frame insertion optimization.

As will be appreciated by one skilled in the art, aspects of the present disclosure may be embodied as a system, method, or program product. Accordingly, aspects of the present disclosure may take the form of an entirely hardware embodiment, an entirely software embodiment (including firmware, micro-code, etc.) or an embodiment combining software and hardware aspects that may all generally be referred to herein as a "circuit," "module" or "system."

The electronic device 600 according to this embodiment of the present disclosure is described below with reference to FIG. 12. The electronic device 600 as shown in FIG. 12 is merely an example, and no limitation should be imposed on functions or scope of use of the embodiment of the present disclosure.

Figure 12:
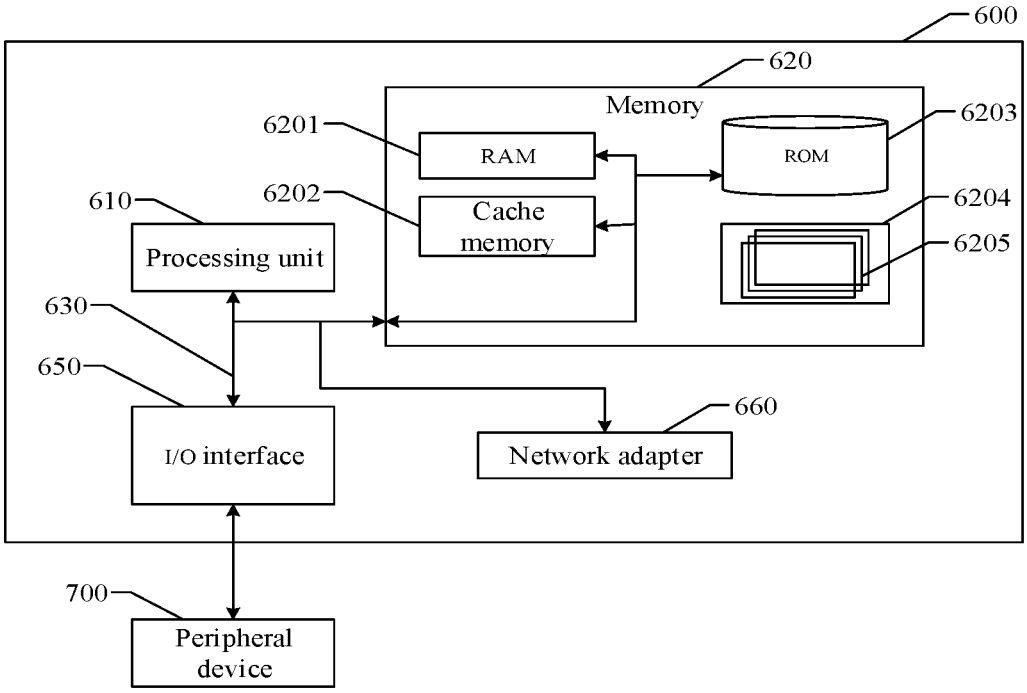
FIG. 12 schematically illustrates another schematic diagram of an apparatus for backlight black frame insertion optimization according to an exemplary embodiment of the present disclosure.

As shown in FIG. 12, the electronic device 600 is shown in the form of a general-purpose computing device. Components of the electronic device 600 may include, but are not limited to: at least one processing unit 610, at least one memory 620, and a bus 630 connecting different system components (including the memory 620 and the processing unit 610).

The memory stores a program code, which may be executed by the processing unit 610, such that the processing unit 610 performs steps described in the "exemplary method" portions of the specification according to exemplary embodiments of the present disclosure. For example, the processing unit 610 may perform Step S110, Step S120, and Step S130 as shown in FIG. 1.

The memory 620 may include non-transitory computer-readable media in the form of volatile memory, such as a random access memory (RAM) 6201 and/or a cache memory 6202. Furthermore, the memory 620 may further include a read-only memory (ROM) 6203.

The memory 620 may include a program/utility tool 6204 having a group of (at least one) program modules 6205. The program modules 6205 include, but are not limited to: an operating system, one or more applications, other program modules and program data. Each or a certain combination of these examples may include implementation of network environment.

The bus 630 may represent one or more of a plurality of bus structures, including a memory bus or memory controller, a peripheral bus, an accelerated graphics port, a processing unit or a local bus using any bus structure among the plurality of bus structures.

The electronic device 600 may communicate with one or more peripheral devices 700 (such as keyboards, pointing devices, Bluetooth devices, etc.), and also may communicate with one or more devices allowing a user to interact with the electronic device 600, and/or may communicate with any device (for example, a router, a modem and so on) allowing the electronic device 600 to communicate with one or more other computing devices. This communication may be implemented by means of an input/output (I/O) interface 650. Moreover, the electronic device 600 also may communicate with one or more networks (for example, a local area network (LAN), a wide area network (WAN) and/or a public network such as the Internet) via a network adapter 660. As shown in FIG. 6, the network adapter 660 communicates with other modules of the electronic device 600 through the bus 630. It should be understood that although not shown in the figures, other hardware and/or software modules may be used in combination with the electronic device 600, including but not limited to: microcode, device drivers, redundancy processing units, external disk drive arrays, redundant arrays of independent disks (RAID) systems, tape drives and data backup and storage systems, etc.

With description of the above embodiments, it will be readily understood by those skilled in the art that the exemplary embodiments described herein may be implemented by software or may be implemented by means of software in combination with the necessary hardware. Thus, the technical solution according to the embodiments of the present disclosure may be embodied in the form of a software product which may be stored in a nonvolatile storage medium (which may be CD-ROM, USB flash disk, mobile hard disk and the like) or on network, including a number of instructions for enabling a computing device (which may be a personal computer, a server, a terminal device, or a network device and the like) to perform the method according to the embodiments of the present disclosure.

In an exemplary embodiment of the present disclosure, there is further provided a computer readable storage medium storing a program product capable of implementing the above method in the specification. In some possible embodiments, aspects of the present disclosure may be implemented as a form of a program product, which includes a program code. When the program product runs on the terminal device, the program code is used for enabling the terminal device to perform the steps described in the above "exemplary method" portions of this specification according to the exemplary embodiments of the present disclosure.

Figure 13:
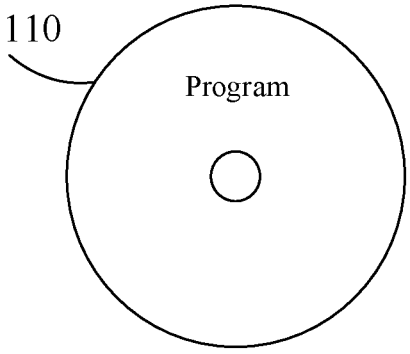
FIG. 13 schematically illustrates a schematic diagram of a program product of a method for backlight black frame insertion optimization according to an exemplary embodiment of the present disclosure.

Referring to FIG. 13, a program product 110 configured to implement the above method is described according to the embodiments of the present disclosure. The program product 800 may adopt a portable compact disc read-only memory (CD-ROM) and include a program code and may run on a terminal device, such as a personal computer. However, the program product of the present disclosure is not limited thereto. In this document, a readable storage medium may be any tangible medium that can contain or store a program for use by or in connection with an instruction execution system, apparatus, or device.

Any combination of one or more readable medium(s) may be utilized by the program product. The readable medium may be a readable signal medium or a readable storage medium. The readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the readable storage medium include the following: an electrical connection having one or more wires, a portable diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

A computer readable signal medium may include a propagated data signal with readable program code embodied therein, for example, in baseband or as part of a carrier wave. Such a propagated data signal may take any of a variety of forms, including, but not limited to, electro-magnetic, optical, or any suitable combination thereof. A readable signal medium may be any readable medium that is not a readable storage medium and that can communicate, propagate, or transport a program for use by or in connection with an instruction execution system, apparatus, or device.

Program code embodied on a readable medium may be transmitted using any appropriate medium, including but not limited to wireless, wireline, optical fiber cable, RF, etc., or any suitable combination of the foregoing.

Program code for carrying out operations of the present disclosure may be written in any combination of one or more programming languages, including an object-oriented programming language, such as Java, C++ or the like, and conventional procedural programming languages, such as the "C" programming language or similar programming languages. The program code may execute entirely on the user's computing device, partly on the user's computing device, as a stand-alone software package, partly on the user's computing device and partly on a remote computing device or entirely on the remote computing device or server.

In the latter scenario, the remote computing device may be coupled to the user's computing device through any type of network, including a local area network (LAN) or a wide area network (WAN), or may be coupled to an external computing device (for example, through the Internet using an Internet Service Provider).

Moreover, the above accompanying drawings are merely illustrative description of processes included in the method according to the exemplary embodiments of the present disclosure and are not intended to limit the present disclosure. It is easy to understand that the processes shown in the above accompanying drawings do not indicate or limit time sequences of these processes. Furthermore, it is also easy to understand that these processes may be executed, for example, synchronously or asynchronously in a plurality of modules.

Other embodiments of the present disclosure will be apparent to those skilled in the art from consideration of the specification and practice of the invention disclosed here. This application is intended to cover any variations, uses, or adaptations of the present disclosure following the general principles thereof and including such departures from the present disclosure as come within known or customary practice in the art. It is intended that the specification and embodiments be considered as exemplary only, with a true scope and spirit of the present disclosure being indicated by the appended claims.

What is claimed is:

1. A method for backlight black frame insertion optimization, the method being applied to a wearable smart device comprising a sensor, wherein the method comprises:

acquiring a current display mode of the wearable smart device;

acquiring a current motion state of the wearable smart device by: acquiring raw data collected by the sensor; processing the raw data to obtain current posture information of the wearable smart device; and determining the current motion state of the wearable smart device according to historical posture information and the current posture information of the wearable smart device, the current motion state comprising a continuous motion state and a non-continuous motion state; and generating a control signal according to the current display mode and the current motion state to adjust backlight black frame insertion of the wearable smart device.

2. The method for backlight black frame insertion optimization according to claim 1, wherein:

the control signal comprises a first control signal; and generating the control signal according to the current display mode and the current motion state to adjust the backlight black frame insertion of the wearable smart device comprises: generating the first control signal to control the wearable smart device to perform the backlight black frame insertion in response to the current display mode being a non-two-dimensional display mode and the wearable smart device being in the continuous motion state.

3. The method for backlight black frame insertion optimization according to claim 1, wherein:

the control signal comprises a second control signal; and generating the control signal according to the current display mode and the current motion state to adjust the backlight black frame insertion of the wearable smart device comprises: generating the second control signal to control the wearable smart device not to perform the backlight black frame insertion in response to the current display mode being a two-dimensional display mode or the current display mode being a non-two-dimensional display mode and the wearable smart device being in the non-continuous motion state.

4. The method for backlight black frame insertion optimization according to claim 1, wherein:

the current posture information is $N^{th}$ posture information, and the historical posture information comprises $(N-1)^{th}$ posture information and $(N-2)^{th}$ posture information, N being a positive integer greater than or equal to 3; and determining the current motion state of the wearable smart device according to the historical posture information and the current posture information of the wearable smart device comprises:

obtaining a posture variation degree of the $(N-1)^{th}$ posture and a posture variation degree of the $(N-2)^{th}$ posture according to the $(N-1)^{th}$ posture information and the $(N-2)^{th}$ posture information;

obtaining a posture variation degree of the $N^{th}$ posture and the posture variation degree of the $(N-2)^{th}$ posture according to the $N^{th}$ posture information and the $(N-2)^{th}$ posture information in response to the posture variation degree of the $(N-1)^{th}$ posture and the posture variation degree of the $(N-2)^{th}$ posture exceeding a predetermined threshold; and determining the current motion state of the wearable smart device as the continuous motion state in response to the posture variation degree of the $N^{th}$ posture and the posture variation degree of the $(N-2)^{th}$ posture exceeding the predetermined threshold.

5. The method for backlight black frame insertion optimization according to claim 4, wherein determining the current motion state of the wearable smart device according to the historical posture information and the current posture information of the wearable smart device further comprises:

determining the current motion state of the wearable smart device as the non-continuous motion state in response to the posture variation degree of the $(N-1)^{th}$ posture and the posture variation degree of the $(N-2)^{th}$ posture not exceeding the predetermined threshold or the posture variation degree of the $N^{th}$ posture and the posture variation degree of the $(N-2)^{th}$ posture not exceeding the predetermined threshold.

6. A non-transitory computer-readable medium, storing a computer program, wherein the computer program is executable by the processor, whereby the method for backlight black frame insertion optimization according to claim 1 is implemented.

7. The non-transitory computer-readable medium according to claim 6, wherein:

the control signal comprises a first control signal; and generating the control signal according to the current display mode and the current motion state to adjust the backlight black frame insertion of the wearable smart device comprises: generating the first control signal to control the wearable smart device to perform the backlight black frame insertion in response to the current display mode being a non-two-dimensional display mode and the wearable smart device being in the continuous motion state.

8. The non-transitory computer-readable medium according to claim 6, wherein:

the control signal comprises a second control signal; and generating the control signal according to the current display mode and the current motion state to adjust the backlight black frame insertion of the wearable smart device comprises: generating the second control signal to control the wearable smart device not to perform the backlight black frame insertion in response to the current display mode being a two-dimensional display mode or the current display mode being the non-two-dimensional display mode and the wearable smart device being in the non-continuous motion state.

9. An electronic device, comprising:

at least one hardware processor; and a storage apparatus configured to store at least one program, wherein the at least one program is executable by the at least one hardware processor, whereby the at least one processor is configured to implement the method for backlight black frame insertion optimization according to claim 1.

10. The electronic device according to claim 9, wherein:

the control signal comprises a first control signal; and generating the control signal according to the current display mode and the current motion state to adjust the backlight black frame insertion of the wearable smart device comprises: generating the first control signal to control the wearable smart device to perform backlight black frame insertion in response to the current display mode being a non-two-dimensional display mode and the wearable smart device being in the continuous motion state.

11. The electronic device according to claim 9, wherein:

the control signal comprises a second control signal; and generating the control signal according to the current display mode and the current motion state to adjust the backlight black frame insertion of the wearable smart device comprises: generating the second control signal to control the wearable smart device not to perform the backlight black frame insertion in response to the current display mode being a two-dimensional display mode or the current display mode being a non-two-dimensional display mode and the wearable smart device being in the non-continuous motion state.

12. A method for backlight black frame insertion optimization, the method being applied to a wearable smart device comprising a processor, a sensor, a backlight driver chip, and a backlight, wherein the method comprises:

acquiring, by the processor, a current display mode and a current motion state of the wearable smart device, which comprising acquiring raw data collected by the sensor; processing the raw data to obtain current posture information of the wearable smart device; and determining the current motion state of the wearable smart device according to historical posture information and the current posture information of the wearable smart device, the current motion state comprising a continuous motion state and a non-continuous motion state, and generating, by the processor, a control signal according to the current display mode and the current motion state; and generating a pulse modulation signal by the backlight driver chip according to the control signal to control on/off of a backlight lamp of the backlight.

13. The method for backlight black frame insertion optimization according to claim 12, wherein:

the processor comprises a kernel layer, a native layer, and an application layer; and acquiring, by the processor, the current motion state of the wearable smart device comprises:

transferring raw data of the wearable smart device collected by the sensor to the native layer through the kernel layer;

obtaining a quaternion by performing data fusion on the native layer, converting the quaternion into an Euler angle, and sending the Euler angle to the application layer; and obtaining, by the application layer, the current motion state of the wearable smart device according to the Euler angle.

14. The method for backlight black frame insertion optimization according to claim 13, wherein:

the wearable smart device further comprising a backlight controller; and generating, by the processor, the control signal according to the current display mode and the current motion state comprises:

generating, by the application layer, the control signal according to the current display mode and the current motion state; and sending, by the application layer, the control signal to the backlight controller via the native layer and the kernel layer sequentially.

15. The method for backlight black frame insertion optimization according to claim 14, wherein:

the control signal comprises a first control signal and a second control signal; and generating the pulse modulation signal by the backlight driver chip according to the control signal to control on/off of the backlight lamp of the backlight comprises:

parsing the control signal and sending the same to the backlight driver chip by the backlight controller;

generating, by the backlight driver chip, the pulse modulation signal having a predetermined duty cycle to alternately turn on and off the backlight lamp in response to the control signal being the first control signal; and generating a DC signal by the backlight driver chip to continuously turn on the backlight lamp in response to the control signal being the second control signal.

16. The method for backlight black frame insertion optimization according to claim 12, wherein the wearable smart device is a virtual reality device.

17. An apparatus for backlight black frame insertion optimization, the apparatus being applied to a wearable smart device comprising a sensor, wherein the apparatus comprises:

a display mode acquiring module configured to acquire a current display mode of the wearable smart device;

a motion state acquiring module configured to acquire a current motion state of the wearable smart device by: acquiring raw data collected by the sensor, processing the raw data to obtain current posture information of the wearable smart device; and determining the current motion state of the wearable smart device according to historical posture information and the current posture information of the wearable smart device, the current motion state comprising a continuous motion state and a non-continuous motion state; and a black frame insertion optimization module configured to adjust backlight black frame insertion of the wearable smart device according to the current display mode and the current motion state.

* * * * *